US005649408A

United States Patent [19]

Mazeiller

[11] Patent Number: 5,649,408

[45] Date of Patent: Jul. 22, 1997

[54] PROGRAMMABLE OFFICE MACHINE FOR CARRYING OUT MAIL PROCESSING TASKS

[75] Inventor: Dominique Mazeiller, La Frette, France

[73] Assignee: Neopost Industrie, Bagneux, France

[21] Appl. No.: 365,762

[22] Filed: Dec. 28, 1994

[30] Foreign Application Priority Data

Dec. 30, 1993 [FR] France ..... 93 15907

[51] Int. Cl.[6] ..... B43M 3/04; B65B 57/00; B65B 59/00

[52] U.S. Cl. ..... 53/460; 53/77; 53/201; 53/284.3

[58] Field of Search ..... 53/460, 411, 284.3, 53/569, 206, 494, 495, 52, 77, 117, 429, 201

[56] References Cited

U.S. PATENT DOCUMENTS

| | | | |
|---|---|---|---|
| 5,045,043 | 9/1991 | Brown et al. | 493/245 |
| 5,388,815 | 2/1995 | Hill et al. | 53/460 X |
| 5,445,367 | 8/1995 | Long | 53/284.3 X |

FOREIGN PATENT DOCUMENTS

| | | |
|---|---|---|
| 0098742A3 | 1/1984 | European Pat. Off. . |
| 0102699A2 | 3/1984 | European Pat. Off. . |
| 0102704A3 | 3/1984 | European Pat. Off. . |
| 2580842A1 | 10/1986 | France . |
| 2681847A1 | 4/1993 | France . |

OTHER PUBLICATIONS

French Search Report FR 9315907.

*Primary Examiner*—James F. Coan

*Attorney, Agent, or Firm*—Sughrue, Mion, Zinn, Macpeak & Seas

[57] ABSTRACT

An office machine for processing mail items includes mechanical elements for folding mail items and inserting them in envelopes and a data processing unit operating under the control of a configuration program to place the mechanical elements of the machine in a particular operating mode in accordance with configuration data. An interface receives a portable external element including a memory and inserted into an opening in the machine at the location of the interface means. The processing unit reads configuration data previously stored in the memory of the portable element when the machine is switched on with the portable element present in the interface means in order to place the mechanical elements of the machine in the operating mode corresponding to the configuration data.

6 Claims, 2 Drawing Sheets

PROGRAMMABLE OFFICE MACHINE FOR CARRYING OUT MAIL PROCESSING TASKS

BACKGROUND OF THE INVENTION

1. Field of the Invention

The invention concerns an office machine for processing mail items and including mechanical elements for folding mail items and inserting them in envelopes and a data processing unit operating under the control of a configuration program to place the mechanical elements of the machine in a particular operating mode accordance with configuration data.

2. Description of the Prior Art

Machines of this kind are widely used in offices which send out mail, in particular for mailing letters conveying or enclosing advertizing type information. A machine of this kind is described in patent application FR-9111992. In this machine the mechanical elements comprise one or more folding abutments adjustable in position by a motor which moves them in translation. The motor is controlled by the processing unit under the control of a program adapted to receive input data entered via a keyboard by a user of the machine. A similar machine is described in document U.S. Pat. No. 5,045,043.

An object of the invention is to improve further a machine of this kind by eliminating any need for manual setting of parameters to place the mechanical elements in the required operating mode and to make the machine more user friendly.

SUMMARY OF THE INVENTION

The invention consists in an office machine for processing mail items including mechanical elements for folding mail items and inserting them in envelopes, a data processing unit operating under the control of a configuration program to place said mechanical elements of said machine in a particular operating mode in accordance with configuration data, and interface means adapted to receive a portable external element including a memory and adapted to be inserted into an opening in said machine at the location of said interface means, in which machine said processing unit is adapted to read configuration data previously stored in said memory of said portable element when said machine is switched on with said portable element present in said interface means in order to place said mechanical elements of said machine in the operating mode corresponding to said configuration data.

A respective external element can be provided for each user of the machine, each such element carrying personalized configuration data that a user can carry about with them.

The removable data support combined with the forced operation of the data processing unit makes the machine very easy to use. The machine can be configured in accordance with the actual requirements of the user who no longer needs to enter machine configuration data via the keyboard.

The support stores data conditioning operation of the machine in various configurations. This data concerns, for example, the envelope format and type, the document format and type, the number and type of letters, the number and formats of documents to be inserted into a given type of envelope. This data can also relate to the destination or qualification of the documents relative to a task to be carried out, for example a letter for the mailing task, a payslip for the payroll task, a bank statement, a tax declaration or a bill for the accounts task, an insert for the advertizing task. In this case the data is directly relevant to the user of the machine. The support can also be of use to the manufacturer of the machine if the data also concerns the identifying number of the machine and the version of the machine and if the support includes one or more programs for statistical monitoring of folding and/or inserting operations. In this case the statistical monitoring programs can be run by the processor as background tasks and the statistical results stored in the data support for later recovery by the machine manufacturer.

The use of a removable data support of this kind therefore eliminates all risk of deterioration or destruction of folding formats held in memory in the machine. The data support can be a smart card or a transportable plug-in unit of the "PAC" type described in patent FR-A-2 580 842 for conveying security information between electronic stations.

This also provides a machine locking function associated with a function for allocating costs by department if the data processing unit is adapted to disable the machine in response to detecting absence of any data support in the machine. In this case the support constitutes a key. It is possible to assign the data support to a particular task to be carried out such as invoicing or secretarial mailing, or uses specific to a department of the company, which facilitates a breakdown of the costs of using the machine.

The invention is described in more detail hereinafter with reference to the drawings.

DETAILED DESCRIPTION OF THE PREFERRED EMBODIMENT

Figure 1:
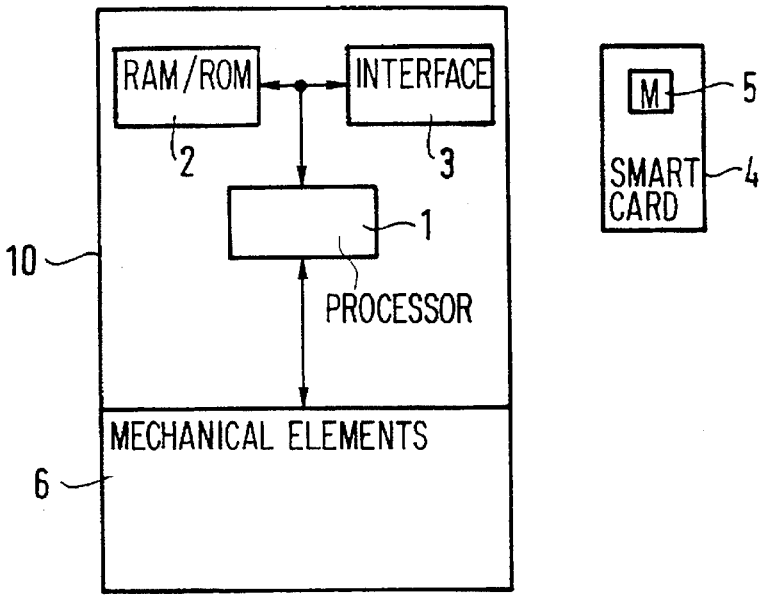
FIG. 1 is a diagrammatic representation of a mail processing office machine including a processor and a smart card type removable data support.

Referring to FIG. 1, the office machine 10 includes a programmable control unit including a processor 1 and an internal random access memory and/or read-only memory (RAM and/or ROM) 2. It also includes mechanical elements 6 which fold mail items and place them in envelopes and/or franks envelopes. These mechanical elements are conventional and constitute part of the prior art. They operate in conjunction with the control unit and are placed in a given operating mode in response to the processor 1 running a configuration program. The expression "given operating mode" refers to a configuration of the mechanical elements such that they fold sheets to be mailed according to particular folding dimensions and insert a particular number of folded sheets into an envelope and/or print an appropriate postal imprint on a mail item.

The machine 10 also includes an interface device, for example a smart card reader 3, mounted behind an opening in the machine, this interface device being adapted to receive an external data support such as a smart card. The reader operates in conjunction with the processor 1. The smart card reader is conventional in itself, apart from the fact that it is adapted to transmit to the processor 1 a signal indicating the presence or the absence of a smart card in the reader. The smart card 4 is conventional.

The non-volatile internal memory 2 holds an initialization program which is run automatically by the processor 1 whenever the machine 10 is switched on. The initialization program includes a routine which detects the absence or the presence of a smart card in the reader 3 according to the state of the signal output by the latter. It also includes a routine which reads the content of the external memory 5 (the memory of the smart card) when a card 4 is inserted into the reader 3. The external memory 5 on the card 4 usually contains one or more programs for configuring the machine 10.

After reading the external memory 5, and either directly or after writing configuration programs into the random access memory part of the internal memory 2, the initialization program causes the processor 1 to run the configuration programs. One effect of running the configuration program(s) is to place the mechanical elements in a particular operating mode.

Figure 2:
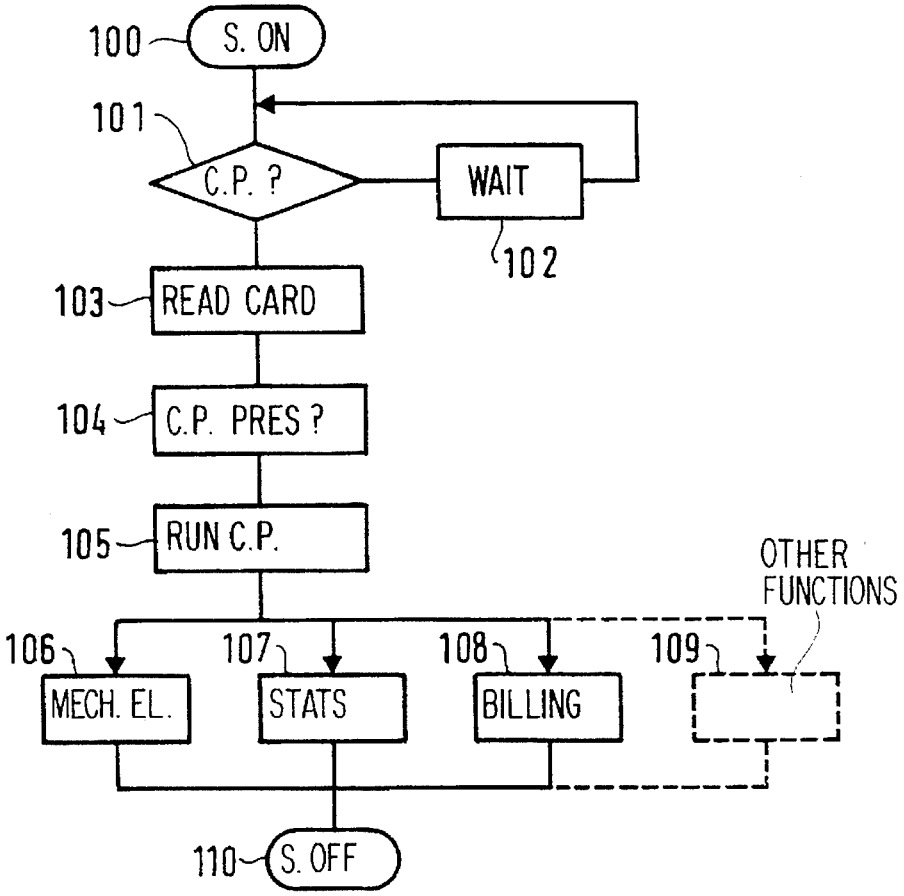
FIG. 2 is a block diagram of the operation of the processor on insertion of the smart card into the machine.

FIG. 2 shows the operation of the processor 1.

The machine is switched on (100).

The initialization program checks for the presence of a smart card in the reader 3 (101). If there is no smart card in the reader, the initialization program waits (102) for the presence of a smart card in the reader 3 to be detected. Operation of the machine 10 is therefore disabled by the initialization program looping on steps 101 and 102.

If a smart card 4 is present in the reader 3 the initialization program reads the content of the smart card (103). It checks for the presence of a configuration program (104). The processor 1 loads the configuration program into the internal memory 2 if necessary.

The processor 1 then runs the configuration program (105). The configuration program can instigate various configuration routines relating to the configuration of the mechanical elements (106) but also to the generation of statistics (107), the reading of billing counters in the machine and the recording of their contents in the external memory (108), or other functions (109). The configuration program ends by switching off the machine (110).

Figure 3:
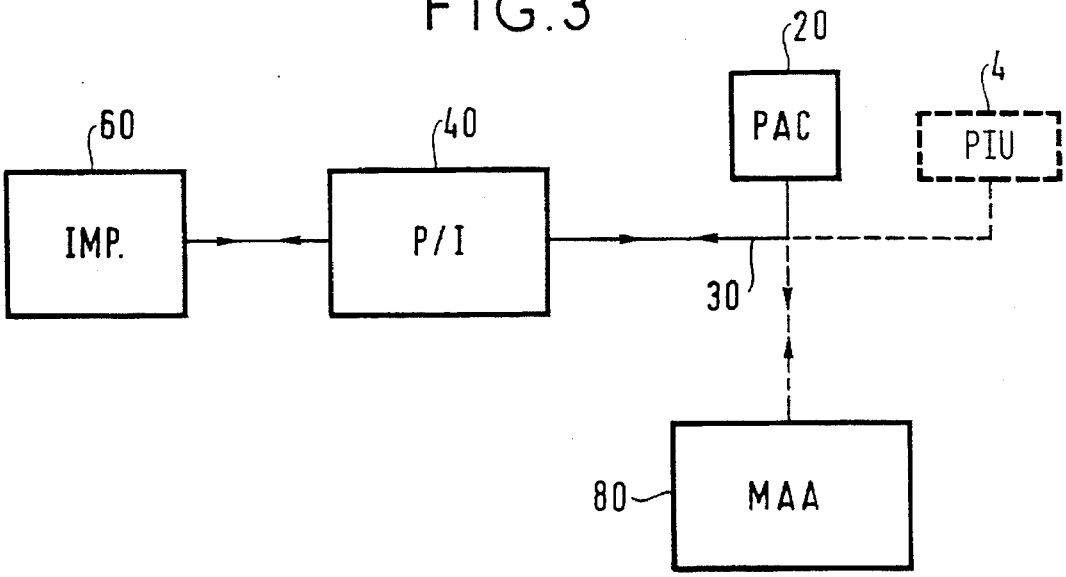
FIGS. 3 and 4 are block diagrams for two examples of mail processing system in accordance with the invention.

Referring to FIG. 3, a plug-in unit (PAC) 20 is connected by a bidirectional serial link 30 to a folder-inserter (P/I) 40. The folder-inserter is connected by a (preferably bidirectional) link to a printer (IMP.) 60 and to an optional franking machine (MAA) 80. Another plug-in unit or a smart card 4, possibly unprogrammed, can replace the plug-in unit 20.

When the machine is switched on the folder-inserter 40 reads the necessary information in the plug-in unit 20 to place itself in a preprogrammed operating mode. Its operation includes reading and writing data in the plug-in unit 20. A series of commands to the folder-inserter 40 or the franking machine 80 enables the operator to print out on the printer 60 information contained in the plug-in unit 20 and relating to counters, statistics, folding parameters, etc.

Figure 4:
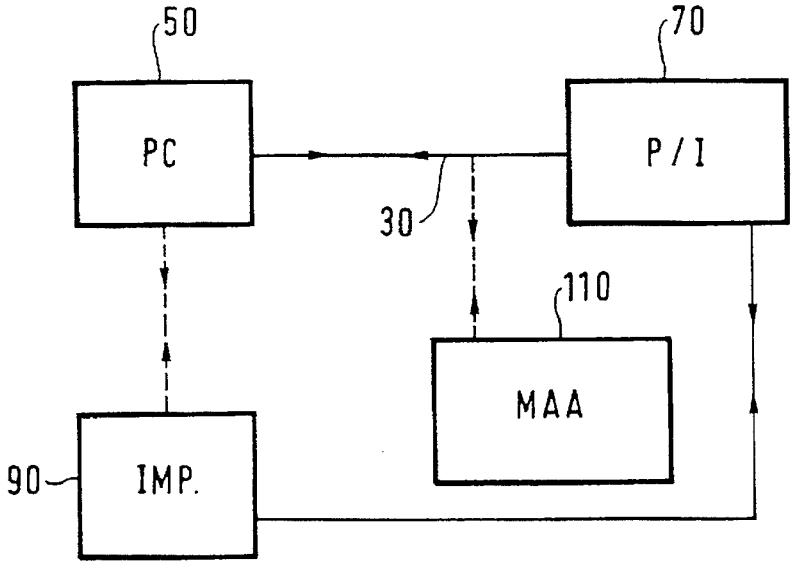

Referring to FIG. 4, a microcomputer (PC) 50 with keyboard and display screen can be connected to the machine via the interface device in substitution for the data support. As previously, it can produce statistics, read counters, store and modify folding parameters, etc.

A non-volatile memory holds data specific to the folder-inserter 70. Outside periods of data modification or capture, the folder-inserter can operate autonomously. When the machine is switched on the folder-inserter 70 assumes the operating mode imposed by the data supplied by the microcomputer 50.

Operation of the microcomputer 50 includes interrogation of the folder-inserter 70 to recover data for producing statements, schedules and statistics.

A series of commands enables the operator to print out on a printer 90 from the folder-inserter or the microcomputer all of the information held in the folder-inserter relating to counters, folding parameters, statistics, etc.

To constitute a complete mail processing system the folder-inserter 40, 70 from FIG. 3, 4 can advantageously be connected to a franking machine 80, 110. The latter can provide the same data support functions as the plug-in unit 20, cassette or smart card 4 or microcomputer 50.

There is claimed:

1. An office machine for processing mail items including mechanical elements for folding mail items and inserting them in envelopes, a data processing unit operating under the control of a configuration program to place said mechanical elements of said machine in a particular operating mode in accordance with configuration data, and interface means adapted to receive a portable external element including a memory and adapted to be inserted into an opening in said machine at the location of said interface means, in which machine said processing unit is adapted to read configuration data previously stored in said memory of said portable element when said machine is switched on with said portable element present in said interface means in order to place said mechanical elements of said machine in the operating mode corresponding to said configuration data, wherein said interface means comprises a smart card reader and said portable element is a smart card.

2. A machine according to claim 1, wherein said processing unit is adapted to disable operation of said machine if said portable element is absent from said interface means.

3. A machine as claimed in claim 1, wherein said portable element is a user-replaceable element which a user inserts into the interface means after switching on said machine.

4. A machine according to claim 1, wherein said data processing unit is adapted to command printing out of configuration data on a printer connected to said machine.

5. A machine according to claim 1, wherein said data processing unit is adapted to store in said memory of said portable element inserted in said interface means data relating to franking operations obtained from a franking machine connected to said machine.

6. An office machine for processing mail items including mechanical elements for folding mail items and inserting them in envelopes, a data processing unit operating under the control of a configuration program to place said mechanical elements of said machine in a particular operating mode in accordance with configuration data, and interface means adapted to receive a portable external element including a memory and adapted to be inserted into an opening in said machine at the location of said interface means, in which machine said processing unit is adapted to read configuration data previously stored in said memory of said portable element when said machine is switched on with said portable element present in said interface means in order to place said mechanical elements of said machine in the operating mode corresponding to said configuration data, wherein said processing unit is adapted to disable operation of said machine if said portable element is absent from said interface means; and wherein said interface means are adapted to supply a signal to said data processing unit if said portable element is present and to supply a different signal to said data processing unit if said portable element is absent.

* * * * *